US011619422B2

(12) United States Patent
Salahub et al.

(10) Patent No.: US 11,619,422 B2
(45) Date of Patent: Apr. 4, 2023

(54) ELECTRIC HEATING DEVICE AND METHOD FOR ITS PRODUCTION

(71) Applicant: Eberspächer catem GmbH & Co. KG, Herxheim (DE)

(72) Inventors: Daniil Salahub, Bad Schönborn (DE); Patrick Kachelhoffer, Seebach (FR)

(73) Assignee: Eberspächer catem GmbH & Co. KG, Herxheim (DE)

( * ) Notice: Subject to any disclaimer, the term of this patent is extended or adjusted under 35 U.S.C. 154(b) by 128 days.

(21) Appl. No.: 17/171,109

(22) Filed: Feb. 9, 2021

(65) Prior Publication Data

US 2021/0247105 A1 Aug. 12, 2021

(30) Foreign Application Priority Data

Feb. 10, 2020 (DE) ..... 10 2020 201 571.6

(51) Int. Cl.

| | |
|---|---|
| ***F24H 9/1818*** | (2022.01) |
| ***F24H 1/12*** | (2022.01) |
| ***H05B 3/06*** | (2006.01) |
| ***H05B 3/14*** | (2006.01) |
| ***H05B 3/26*** | (2006.01) |
| ***F24H 1/00*** | (2022.01) |
| ***F24H 9/02*** | (2006.01) |
| ***H05B 3/32*** | (2006.01) |
| *H05B 3/04* | (2006.01) |

(52) U.S. Cl.

CPC ..... *F24H 9/1827* (2013.01); *F24H 1/0018* (2013.01); *F24H 9/02* (2013.01); *H05B 3/06* (2013.01); *H05B 3/26* (2013.01); *H05B 3/32* (2013.01); *F24H 2250/04* (2013.01); *H05B 3/04* (2013.01); *H05B 2203/016* (2013.01); *H05B 2203/02* (2013.01); *H05B 2203/021* (2013.01)

(58) Field of Classification Search

None

See application file for complete search history.

(56) References Cited

U.S. PATENT DOCUMENTS

| | | | | |
|---|---|---|---|---|
| 2015/0168014 | A1* | 6/2015 | Wu | F24H 3/002 219/202 |
| 2018/0065447 | A1* | 3/2018 | Cmelik | H05B 3/06 |
| 2021/0215393 | A1* | 7/2021 | Barbano | H05B 3/286 |

FOREIGN PATENT DOCUMENTS

| | | |
|---|---|---|
| CN | 109028554 | 12/2018 |
| EP | 1872986 | 1/2008 |
| EP | 2337425 | 6/2011 |

(Continued)

*Primary Examiner* — Joseph M. Pelham

(74) *Attorney, Agent, or Firm* — Boyle Fredrickson S.C.

(57) ABSTRACT

An electric heating device includes a housing having a partition wall which separates a connection chamber from a heating chamber for dissipating heat and from which at least one receiving pocket protrudes into the heating chamber as a heating rib. A PTC heating device with at least one PTC element and conductor tracks for energizing the PTC element with different polarities, which are electrically conductively connected to the latter and which are electrically connected in the connection chamber, are received in the housing. The PTC element and at least one of the conductor tracks are received in a heater casing. The heater casing is pressed into the receiving pocket subject to plastic deformation of the heater casing and/or the receiving pocket.

13 Claims, 5 Drawing Sheets

(56) References Cited

FOREIGN PATENT DOCUMENTS

| | | |
|---|---|---|
| EP | 2637474 | 9/2013 |
| EP | 3 101 365 | 12/2016 |
| EP | 3 290 821 | 3/2018 |
| EP | 3 820 245 | 5/2021 |
| FR | 3 078 018 | 8/2019 |

* cited by examiner

ELECTRIC HEATING DEVICE AND METHOD FOR ITS PRODUCTION

BACKGROUND OF THE INVENTION

1. Field of the Invention

The present invention relates to an electric heating device with a housing having a partition wall which separates a connection chamber from a heating chamber for dissipating heat. At least one receiving pocket protruding into the heating chamber as a heating rib protrudes from the partition wall. A PTC heating device is provided in this pocket. Furthermore, a pressure element is received in the pocket and holds heat extraction surfaces of the PTC element abutted against oppositely disposed inner surfaces of the receiving pocket.

2. Background of the Invention

The PTC heating device has at least one PTC element and conductor tracks abutting thereagainst in an electrically conductive manner. The conductor tracks are connected to the PTC element in an electrically conductive manner. This connection can be a positive-fit and/or force-fit and/or positive substance-fit connection.

The aforementioned general features of the electric heating device apply to prior art according to EP 1 872 986 A1. They also apply to the implementation of the invention.

The earlier proposals EP 2 637 474 A1 and EP 2 337 425 A1, respectively, originating from the applicant each disclose PTC heating devices which are introduced into a previously mentioned receiving pocket.

EP 2 337 425 A1 discloses a solution in which a conductor track abutting against a main side surface of the PTC element is provided as a piece of sheet metal with contact projections bent out of the plane of the piece of sheet metal. The contact projections only serve to improve the electric contact of the PTC element.

In the previously known solutions described above, the receiving pocket tapers towards its lower closed end. Accordingly, the insertion opening that opens to the connection chamber is wider than the lower closed end of the receiving pocket. The PTC elements and the contact plates abutting thereagainst on both sides are typically braced in the receiving pocket with a wedge-shaped pressure element, with the interposition of at least one insulating layer between the conductor tracks and oppositely disposed inner surface of the receiving pocket. This wedge element ensures that the layers of the layer structure are abutted in a clamped manner against one another. These layers are at least the PTC elements and the conductor tracks extending at right angles to the direction of force action of the wedge element, typically contact plates, and at least one insulating layer.

Despite the production-related cross-sectional shape of the receiving pocket conically tapering downwardly, the wedge element is to enable good heat transfer, possibly between the two mutually opposite heat extraction surfaces of the PTC element and the respective inner surfaces of the receiving pocket associated therewith with the interposition of the pressure element. Due to the pressure built up there, the oppositely disposed heat extraction surface of the PTC element is also abutted directly or with the interposition of an insulating layer against the oppositely disposed inner surface of the receiving pocket.

CN 109028554 A discloses an electric heating device including a housing having a partition wall which separates a connection chamber from a heating chamber for dissipating heat. In this prior art, the PTC heating device comprises a pocket-shaped heater casing which has mutually oppositely disposed side sections which are connected to each other by a bottom section and which receives the PTC element and the conductor tracks. The pocket-shaped heater casing accordingly forms a receptacle at least for the PTC heating element. The pocket-shaped heater casing is wedge-shaped in cross-section in order to enable uniform heat-conducting abutment of the heater casing formed as a pressure element against the inner surfaces of a receiving pocket tapering towards its lower end facing away from the connection chamber.

The previously presented prior art solutions each ensure good heat extraction. However, there is the problem that the receiving pocket does not always correspond to the designed shape due to manufacturing tolerances. Because, for production reasons, the PTC elements are subject to considerable dimensional fluctuations. It is also not always ensured that the heat extraction surfaces of the PTC element run completely straight and planar.

Pressing a wedge in as a pressure element can lead to stress peaks, due to which the ceramic PTC element or a ceramic insulating layer can fracture inside the receiving pocket. Depending on the tolerances, the wedge element used as a pressure element in prior art in the specific application might not be thick enough, so that it basically sits uselessly at the lower end of the receiving pocket. If, on the other hand, the free space remaining before the wedge element is introduced is too small, then this results in insufficient coverage of the heat extraction surface of the PTC element in the height direction of the receiving pocket, i.e., between the lower end and the insertion opening. As a result, the PTC element heats up too much and prevents further uptake of power current. Consequently, the degree of efficiency of the PTC element is poor.

There is also the possibility that layers of the PTC heating device and/or the pressure element or the PTC heating device, respectively, as a whole are pressed out of or migrate from the receiving pocket due to vibration.

SUMMARY

The present invention seeks to remedy the aforementioned issues at least in part.

For this purpose, the present invention proposes an electric heating device including a housing having a partition wall which separates a connection chamber from a heating chamber for dissipating heat. A PTC heating device is received in the housing. The PTC heating device includes at least one PTC element and conductor tracks for energizing the PTC element with different polarities. The conductor tracks are electrically connected to the PTC element and are electrically connected in the connection chamber. The PTC element and the at least one conductor track are received in a heater casing. The heater casing is pressed into the receiving pocket subject to plastic deformation of the heater casing and/or the receiving pocket. The receiving pocket protrudes into the heating chamber as a heating rib in a manner that may be known per se. The receiving pocket is typically formed integrally on the partition wall. The receiving pocket is typically made of a material that conducts heat well, typically metal. The receiving pocket by itself or in combination with the partition wall can be produced by deep drawing or casting a metal. The receiving pocket is possibly made of aluminum and is formed integrally on the partition wall by forming, in particular by deep drawing.

The receiving pocket—like the receiving pocket known from prior art—possibly has a wedge-shaped cross-sectional shape which tapers toward the bottom of the receiving pocket, i.e., the end of the heating rib protruding into the heating chamber.

According to the invention, the heater casing is received in this receiving pocket. The heater casing typically accommodates the PTC element completely and the conductor tracks at least to a large degree. In particular, the main side surfaces of the PTC element are typically covered by the heater casing. The heat-dissipating main side surfaces of the PTC element in the assembled state are arranged oppositely disposed to the side surfaces of the heating rib, so that heat can be extracted from the PTC element in a direction transverse to the main side surfaces, be passed through the receiving pocket, and dissipated via the side surfaces to the heating chamber. The heater casing is disposed in this heat conduction path.

The heater casing is typically made of a material that conducts heat well. The heater casing is formed in particular from flowable material, for example copper or aluminum, which has a relatively low strength with good thermal conductivity. The heater casing can also be formed from plastic material that is highly filled with thermally conductive particles. The volumetric degree of filling of the thermally conductive particles should not be less than 60 percent by volume.

The heater casing typically accommodates not only the PTC element and the conductor tracks to a large degree. Disposed between the PTC element and an inner surface of the heater casing is typically also at least one insulating layer which can be formed from electrically insulating material, in particular, plastic or a ceramic material. The insulating layer typically covers the conductor track, which abuts directly in an electrically conductive manner against the PTC element, on the outer side so that this polarity does not directly contact the inner surface of the heater casing.

On the opposite side, the current can be introduced directly through the heater casing which in this case forms the conductor track. Typically, however, two conductor tracks associated with different polarities are received as separate components in the heater casing and are each electrically isolated from the heater casing by an insulating layer. The insulating layers provided parallel to the oppositely disposed main side surfaces of the PTC element can be formed from a single film wrapped around the PTC element on the underside. The PTC element can be received in a positioning frame made of electrically insulating material which positions the PTC element or elements and spaces them apart so that the positioning effect of the positioning frame in the heater casing results in a predetermined alignment and arrangement of the PTC element or elements in the receiving pocket. This position frame can be covered on the outside with the insulating layers or surrounded by a single insulating layer.

According to the present invention, the heater casing is pressed into the receiving pocket subject to plastic deformation of the heater casing and/or the receiving pocket. The heater casing and/or the receiving pocket can have oppositely disposed main sides or inner surfaces, respectively, which are inclined relative to one another at an angle of between 2° and 5°.

As part of the assembly, the heater casing is typically first populated with the elements received therein, i.e., the PTC element of the at least one conductor track and the optionally provided insulating layer. The heater casing is thereafter introduced into the receiving pocket. The plastic deformation takes place thereafter. For this purpose, for example, the heating rib can be plastically deformed in that a deformation tool interacts directly with the heating rib. In addition or alternatively, a deformation tool can also act against the heater casing in order to bring about the plastic deformation according to the invention from the inner side of the receiving pocket. In any case, a close plastically deformed interconnection is obtained between the heater casing and the inner surface of the receiving pocket due to the deformation. Furthermore, due to the deformation of the heater casing and/or the receiving pocket, the PTC element is arranged firmly, in particular in a vibration-resistant manner and with good thermal conductivity, in the heat path between the PTC element and the side surface of the heating rib.

In addition to a vibration-resistant attachment of the PTC element in the receiving pocket, good heat extraction arises with the configurations described above and the receiving pocket is typically filled entirely or at least almost entirely by the components inserted therein, at least in the region of the receiving pocket that is of particular importance for heat extraction from the PTC element. The lower region of the receiving pocket is typically joined with to the heater casing over the entire surface. Contact over the entire surface arises also between the main side surfaces of the PTC element and the associated inner surfaces of the receiving pocket and thereby good heat extraction from the PTC element up to the side surfaces of the heating rib. For the heat conduction presently discussed, the heat conduction path from the main side surfaces into the side surfaces of the heating rib is of particular importance. The face side surfaces of the PTC element can typically only make a smaller contribution to the heat extraction anyway due to their smaller dimensions. The main side surfaces are typically those surfaces which have the greatest extension in the length and width direction, respectively, of the PTC element. The face side surfaces connect these main side surfaces. The PTC element is typically cuboid-shaped and has a much greater extension in the length and width direction, respectively, than in the height and thickness direction, respectively. The thickness direction is typically smaller by at least a factor of 5 than one of the dimensions in the length and/or width direction. The main side surface is there spanned by the two extensions in length and width.

According to a preferred development of the present invention, the heater casing is connected to the receiving pocket in a positive substance-fit manner, in particular as a result of the plastic deformation, is particularly possibly cold-welded. In this preferred further development, the plastic deformation of the heater casing and/or the receiving pocket is to be effected in such a way that a positive substance-fit connection, in particular formed by welding, arises between the heater casing and the receiving pocket.

A face side surface which extends in the direction of introduction of the PTC element substantially transverse can be provided adjacent to the bottom of the receiving pocket. There is typically also material of the heater casing disposed between the bottom of the receiving pocket and this face surface, at least after the plastic deformation. The oppositely disposed face surface extending parallel thereto is disposed adjacent to the connection chamber and can typically contribute little to heat extraction. The face surfaces of the PTC element extending at right angles to these two face surfaces can be exposed in the receiving pocket without a direct heat conducting surface. This is for reasons of good electrical insulation. After the heater casing has been inserted and deformed, the receiving pocket is typically filled with an electrically insulating mass which prevents air and leakage currents and which can be disposed between a face side boundary of the heating rib and the corresponding face surfaces of the PTC element, so that a certain amount of heat can be extracted to the outer surface of the heating rib also via this electrically insulating mass. The mass with good thermal conductivity can be, for example, a curing silicone mass to which particles that are electrically non-conductive but with good thermal conductivity have been added. These particles can be aluminum oxide spheres.

The following consideration relates in particular to a cross-sectional view through the PTC element which intersects the upper and lower face surfaces and extends parallel to the edge-side face surfaces of the PTC element. Formed in a convex manner in such a cross-sectional view is at least one surface of the heater casing abutting against the receiving pocket. This shape of the heater casing can relate to the state prior to the deformation. Typically, however, such a convex configuration arises also in a deformed configuration in which the heater casing abuts with a convex surface against the inner surface of the receiving pocket. As a result of a deformation of the heater casing, the inner pocket can have been deformed in a concave outward manner, corresponding to the convex configuration of the heater casing.

According to a preferred development of the present invention, at least one fixation lip is formed on the heater casing by an undercut. As a result of the heater casing being pressed into the receiving pocket, this fixation lip is plastically deformed at least in sections and abutted against the inner side of the receiving pocket. This further development can be based on the contemplation that a kind of barb or the like is formed by an easily deforming fixation lip and can cause the heater casing to be anchored in the receiving pocket in an improved manner at least after the plastic deformation. The fixation lip can be provided at any point in the height direction, i.e. the direction of introduction of the heater casing into the receiving pocket. In view to the best possible heat extraction between the main side surfaces and the heating rib, however, it is possible to provide the respective fixation lip close to the bottom on the receiving pocket.

In view of this, the present invention proposes to provide the heater casing with two legs and a heater casing bottom connected thereto. For the PTC element and the at least one conductor track, the heater casing forms a substantially U-shaped or V-shaped receiving space, the inner walls of which can be aligned parallel to one another. Said fixation lip is provided on at least one, possibly on two legs, where the at least one fixation lip is provided in the region of the heater casing bottom. By definition, the bottom is that region which in the direction of insertion of the heater casing into the receiving pocket is disposed in front of the PTC element.

According to a preferred further development of the present invention, the heater casing has an abutment surface which in the press-in direction is arranged at a rear end and adapted for the application of a pressing tool. This abutment surface can be formed by a substantially planar surface extending transverse to the press-in direction. The abutment surface can also be formed by a trough-shaped depression. The abutment surface is adapted for the application of a pressing tool. This pressing tool typically acts from the connection chamber onto the heater casing in order to press the heater casing into the receiving pocket, in particular to plastically deform it and thereby cold-weld it in the receiving pocket. This typically takes place when the heater casing is introduced into the receiving pocket.

According to a further development of the present invention, the heater casing can comprise at least one inwardly facing locking projection. In the completed product, this locking projection typically bears in planar manner in the direction toward the PTC element, for example, against the insulating layer. The locking projection can act like a barb which prevents the PTC element from being accidentally released from the heater casing which may be open at the top. After the plastic deformation of the heater casing, this locking projection can basically be integrated into a flat abutment surface that extends parallel to a main side surface of the PTC element and, for example, forms an abutment surface for the insulating layer.

The aforementioned heater casing can be produced as an elongate material by way of pulltrusion or extrusion and then be cut to length so that its length corresponds substantially to the width of the PTC element.

The present invention also specifies a method for producing an electric heating device of the kind specified above. In the method, the PTC element with the at least one conductor track, possibly with the aforementioned insulating layer, is introduced into a heater casing and into the receiving pocket. The heater casing can first be populated with the elements contained therein and thereafter be introduced into the receiving pocket. Alternatively, the heater casing can first be introduced into the receiving pocket and thereafter be populated.

In any case, according to the method of the invention, the heater casing is pressed into the receiving pocket subject to plastic deformation and there possibly cold-welded to the receiving pocket during the introduction of the heater casing or after the introduction of the heater casing and the components received therein.

With the method according to the invention, a heater casing bottom is plastically deformed in the bottom of the receiving pocket when the heater casing is introduced into the receiving pocket, possibly after the heater casing has been populated with the components.

According to a preferred development of the present invention in which the heater casing is first populated with the aforementioned components and thereafter introduced into the receiving pocket, the heater casing is gripped by an insertion tool for the insertion process. Oppositely disposed legs of the heater casing are there typically gripped by the insertion tool and pivoted towards one another. The heater casing is abutted against the PTC element by the insertion tool subject to resilient and/or plastic deformation prior to being inserted into the receiving pocket. The abutment there can be effected directly against the PTC element or with the interposition of an insulating layer or the contact plate, respectively. The aforementioned inwardly facing locking projection of the heater casing is typically plastically deformed with this methodical procedure, so that a planar mating surface on the sides of the heater casing is formed for the PTC element on both main sides thereof, where the PTC element abuts directly or indirectly against the abutment surface with the interposition of the contact plate and/or the insulating layer.

BRIEF DESCRIPTION OF THE DRAWINGS

Further details and advantages of the present invention shall arise from the following description of embodiments in combination with the drawing, in which.

DETAILED DESCRIPTION

Figure 1:
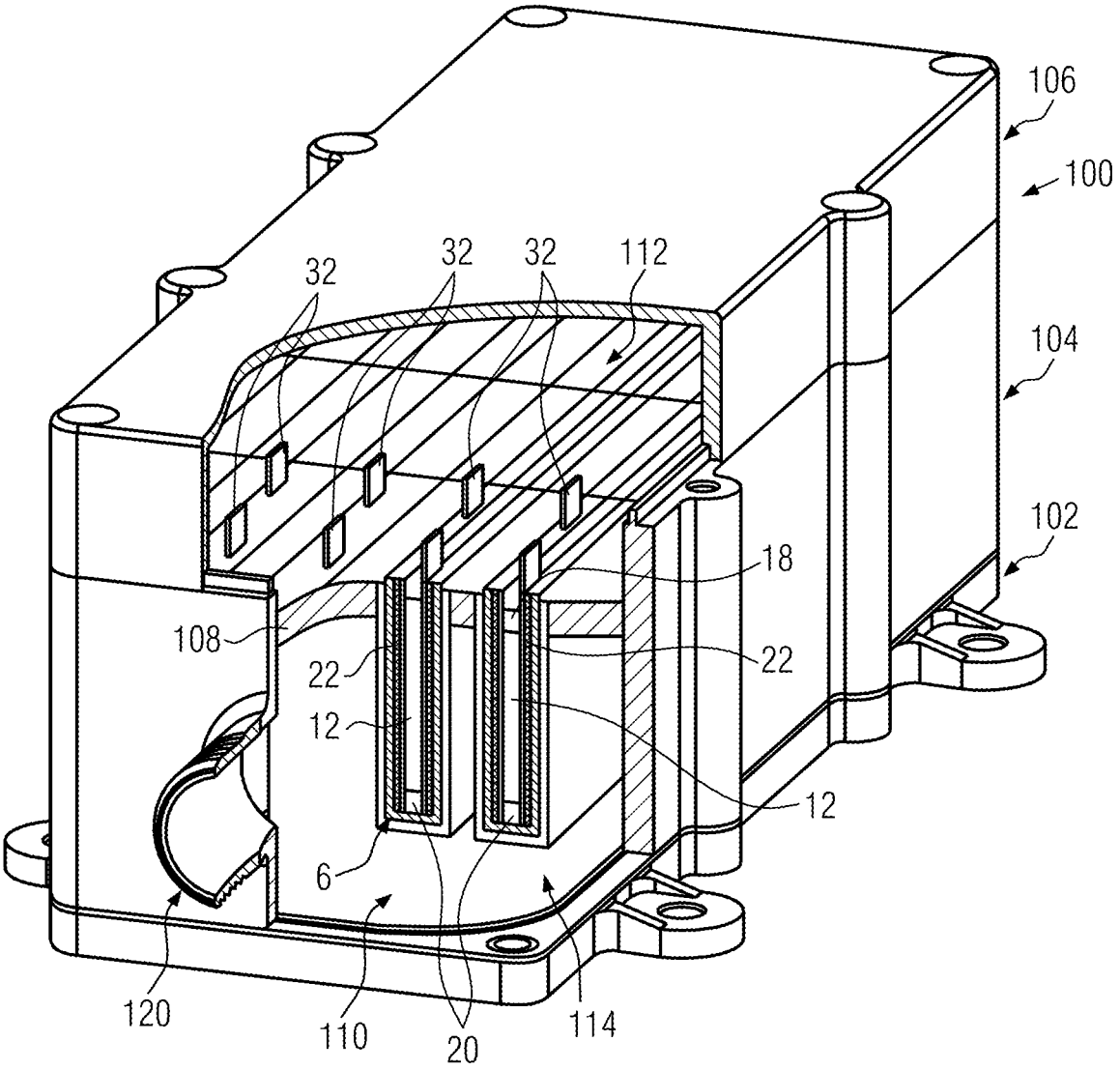
FIG. 1 shows a perspective side view of an embodiment of an electric heating device with the housing partially removed.

FIG. 1 shows a housing 100 of an electric heating device which comprises a bottom element 102, a housing base 104, and a housing cover 106. In the embodiment shown, the housing base 104 forms a partition wall 108 extending parallel to the housing bottom 102 and separating a circulation or heating chamber 110, respectively, from a connection chamber 112. In the embodiment shown, at least the housing base 104 is produced integrally formed from aluminum. Heating ribs 114 protrude from the partition wall 108 in the direction toward the heating chamber 110. These heating ribs are formed to taper conically at an angle of approximately 2.5° towards their fine end and form a receiving pocket 116 with oppositely disposed inner surfaces 118. The interior of the heating rib 114 and the connection chamber 112 are fluidically separated from the heating chamber 110.

Connections presently lead to the heating chamber 110 on oppositely disposed face sides of the housing base 104. These connections are formed as hose or pipe connection ports 120 and protrude on the exterior from the actual wall of the housing base 104. They are used to connect hoses or lines that carry liquid fluid to be heated, which is to be heated in the heating chamber 110.

For this purpose, the receiving pockets 116 are each equipped with PTC heating devices 2. One or more of these PTC heating devices 2 can be inserted one behind the other in the longitudinal direction of the heating ribs 114 into the individual receiving pockets 116.

Figure 2:
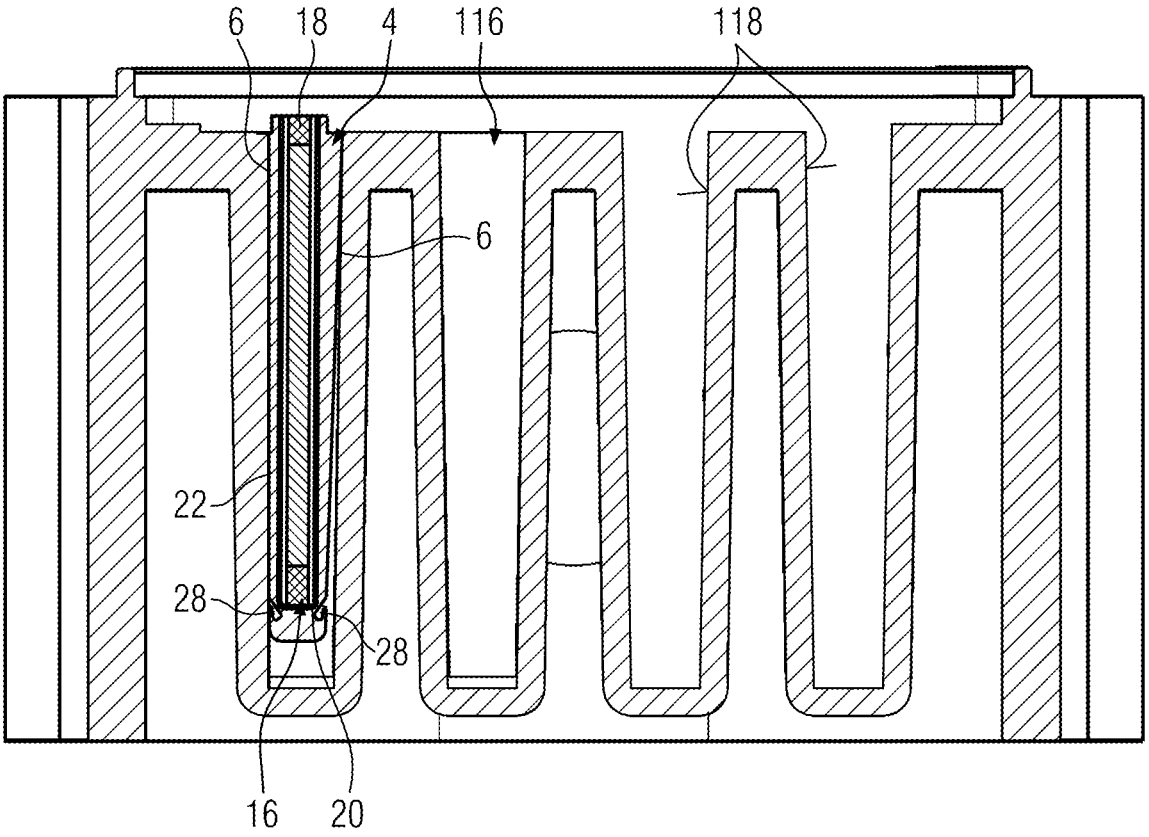
FIG. 2 shows a cross-sectional view of the housing base, identified by reference numeral 102 in FIG. 1, with a first variant of a heater casing which is pressed into a receiving pocket.

The essential structure of the PTC heating device 2 for the variants discussed below is basically identical. The PTC heating device 2 has a respective heater casing 4 which comprises oppositely disposed legs 6 which are connected to one another pivotable via a heater casing base 8. The heater casing 4 is open on the side opposite the heater casing bottom 8. It typically has contact plates 10 protruding over itself which directly abut against a PTC element 12 in an electrically conductive manner and form connection lugs 14, formed integrally by punching and bending sheet metal material forming the contact plates 10, as contact strips for the plugged contact of the PTC heating device 2. These connection lugs 14 are shown in FIG. 2. Detailing the connection lugs is dispensed with in the other illustrations according to FIG. 3 et. seqq.

As shown in the sectional view according to FIG. 2, the PTC element 12 is disposed in a circumferentially enclosed receptacle of a positioning frame 16 made of insulating material, of which only the upper and lower frame struts 18, 20 can be seen in FIG. 1. The PTC element 12 typically protrudes in the thickness direction, i.e. a thickness direction of the receiving pocket 116, over the frame struts 18, 20 so that the electrically conductive abutment of the contact plates 10 against the PTC element 12 is not impaired by the positioning frame 16.

On the side opposite the PTC element 12, an insulating layer 22 abuts against the outside of the contact plates 10. This insulating layer 22 is formed integrally and wraps around the positioning frame 16 on the underside.

The elements of the PTC heating device 2 described above are received in the heater casing 4 which is presently formed from aluminum and produced by extrusion and cut to length. The width of this heater casing 4 presently corresponds approximately to the width of the PTC element 12. The width direction extends transverse to the plane of illustration according to FIG. 2. The further dimension of the PTC element 12 that can presently be seen in addition to the thickness is the length. This extension roughly corresponds to the direction of insertion of the PTC heating device 2 into the receiving pocket 116.

The right-hand leg 6 of the heater casing 4 in FIG. 2 is formed to be thickened as compared to the left-hand leg and has an abutment surface 26 which extends substantially transverse to the direction of insertion and which is formed planar and end-to-end over the width of the heater casing 4. Above this abutment surface 26, the right-hand leg 6, like the left-hand leg 6, is formed as a substantially thin and planar plate.

The sectional view shows fixation lips 28 which protrude from the bottom in the width direction, and which protruded further in the transverse direction before the heater casing 4 was inserted into the receiving pocket 116, and were deformed parallel to the inner surfaces 118 during the introduction into the receiving pocket 16. These fixation lips 28 can act like barbs.

The heater casing 4 is plastically deformed in the receiving pocket 116 due to the application of force in a planar manner upon the abutment surface 26. With this plastic deformation, the heating rib 114 can also permanently deform. In any case, a cold weld results due to the plastic deformation. For this purpose, pressure can be applied against the abutment surface 26 with a pressing force between 1400 and 3000 Newtons. The aluminum material of the heater casing 4 then flows and bonds with the inner surfaces 118 of the receiving pocket 116 in a positive substance-fit manner.

The components of the PTC heating device that are received within the heater casing 4, namely the PTC element 12 previously inserted into the receptacle of the positioning frame 16, the contact plates 10 abutting thereagainst, and the insulating layer 22 can typically be introduced as a unit between the legs 6 of the heater casing 4 before the latter is introduced into the receiving pocket 116 and pressed thereinto.

FIGS. 3 to 7 show variants of the heater casing 4. For the remainder, the same components like in the previous description are provided with the same reference numerals. In the representations according to FIGS. 3 to 7, the respective heater casing 4 with the components received therein has not yet been fully inserted into the receiving pocket 116. Instead, it projects in part beyond the partition wall 108.

In the previously discussed embodiment, the heater casing 4 forms legs 6 with planar outer surfaces. These outer surfaces, while diverging, are flat, i.e. planar.

Figure 3:
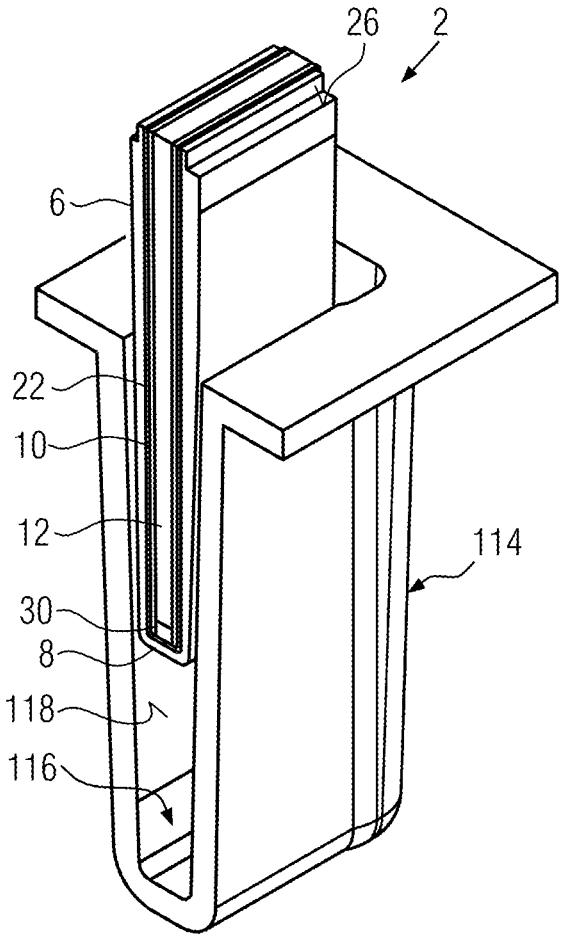
FIG. 3 shows a perspective sectional view of the receiving pocket with a second variant of a heater casing prior to being completely introduced into the receiving pocket.

In the variant shown in FIG. 3, the legs 6 are formed to be slightly convex. They have a radius of between 500 and 1000 mm. The fixation lips 28 are dispensed with in this embodiment. Instead of a positioning frame 16, only an electrically non-conductive plastic web 30 is provided between a bottom of the heating rib 114 and the PTC element 12. The abutment surfaces 26 are formed on both sides of the PTC element 12 on the two legs 6. When the pressing force is applied on both sides of the PTC element, the material forming the heater casing 4 flows and therefore a more uniform bond arises between the heater casing and the inner surfaces 118. In addition, the PTC element 12 can be arranged at the center of the receiving pocket 116 so that the same heat dissipation conditions prevail on both main side surfaces of the PTC element 12. The main side surface is that surface which extends in the longitudinal direction and in the width direction of the PTC element 12.

Figure 4:
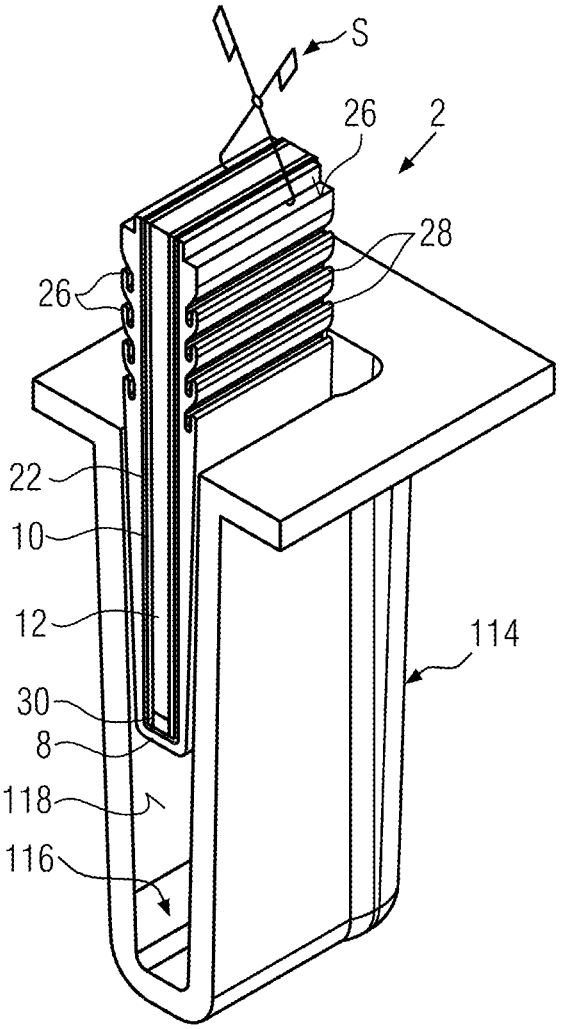
FIG. 4 shows a perspective sectional view of the receiving pocket with a third variant of a heater casing prior to being completely introduced into the receiving pocket.

In the variant according to FIG. 4, a plurality of fixation lips 28 is formed disposed opposite the main side surfaces of the PTC element 12. They are confined to the upper region of the PTC element 12. For the remainder, the third variant shown in FIG. 4 corresponds to the second variant according to FIG. 3.

Figure 5:
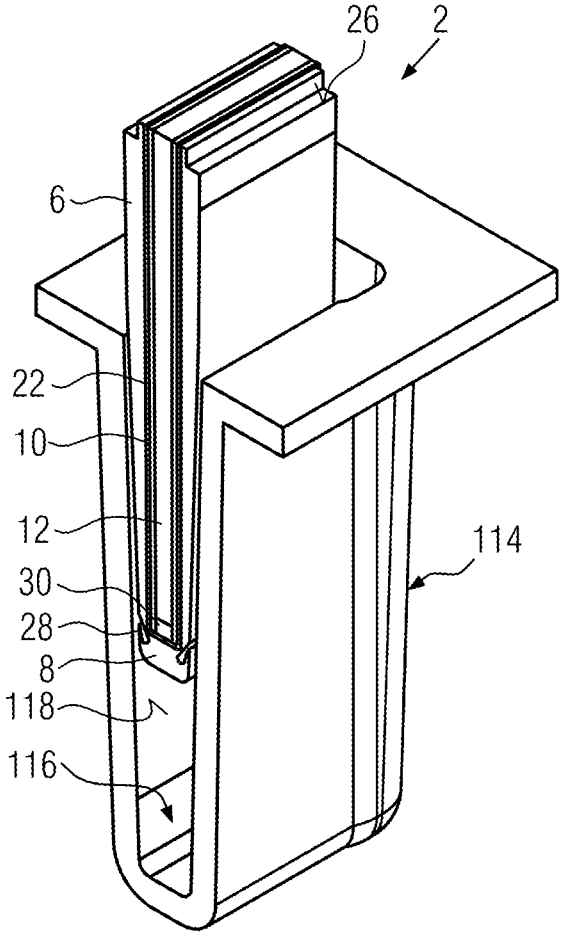
FIG. 5 shows a perspective sectional view of the receiving pocket with a fourth variant of a heater casing prior to being completely introduced into the receiving pocket.

In the fourth variant according to FIG. 5, fixation lips 28 are formed only in the region of the heater casing bottom 8. These fixation lips 28 deform inter alia in the bottom of the receiving pocket 116. Two abutment surfaces 26 are formed there as well. The outer surfaces of the legs 6 are convex.

Figure 6:
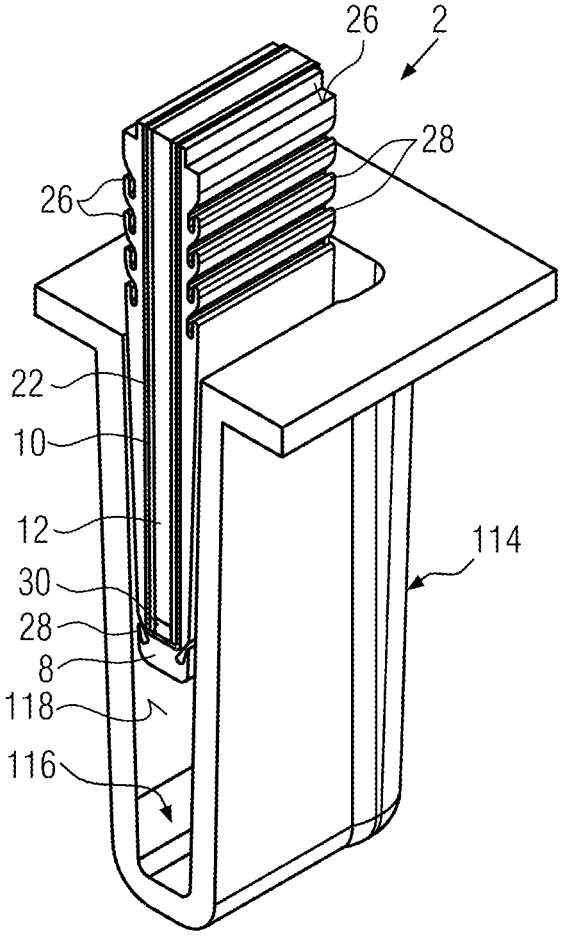
FIG. 6 shows a perspective sectional view of the receiving pocket with a fifth variant of a heater casing prior to being completely introduced into the receiving pocket.

The variant shown in FIG. 6 combines the variant according to FIGS. 4 and 5.

Figure 7:
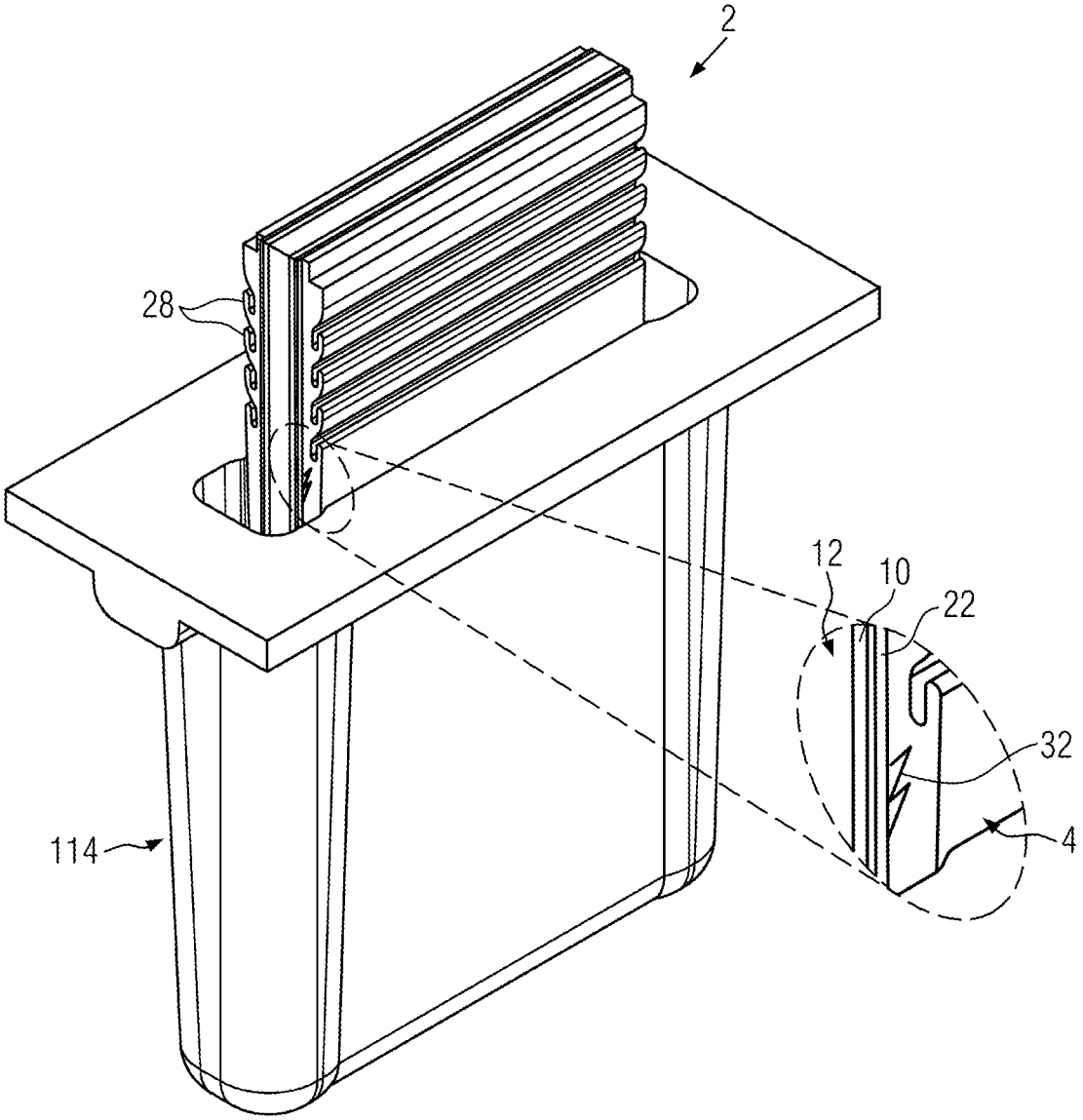
FIG. 7 shows the embodiment according to FIG. 6 in a side view with an entire heating rib.

FIG. 7 shows a view of the entire width extension of the receiving pocket 116 and the PTC heating device 12. At the face side of the PTC heating device, a certain gap to the face side boundary of the receiving pocket 116 remains. After the introduction of the PTC heating device 2 into the receiving pocket 116, the remaining free space within the receiving pocket 116 can be filled with a typically electrically insulating mass that is thermally well conductive.

FIG. 7 exemplifies an inwardly facing locking projection 32. In the completed product, this locking projection 32 bears in planar manner in the direction toward the PTC element 12, in the present case against the insulating layer 22. The locking projection 32 acts like a barb which prevents the PTC element 12 from being accidentally released from the heater casing 4. After the plastic deformation of the heater casing 4, this locking projection 32 is basically integrated into a flat abutment surface that extends parallel to the insulating layer 22.

The invention claimed is:

1. An electric heating device comprising:

a housing having a partition wall which separates a connection chamber from a heating chamber for dissipating heat, wherein at least one receiving pocket protrudes into the heating chamber as a heating rib;

a PTC heating device received in the housing, the PTC heating device including at least one PTC element and conductor tracks for energizing the PTC element with different polarities, the conductor tracks being electrically connected to the PTC element and being electrically connected in the connection chamber, wherein the PTC element and the at least one conductor track are received in a heater casing, and wherein the heater casing is pressed into the receiving pocket subject to plastic deformation of the heater casing and/or the receiving pocket; and wherein the heater casing is cold-welded to the receiving pocket.

2. The electric heating device according to claim 1, wherein at least one surface of the heater casing abutting against the receiving pocket is convex.

3. The electric heating device according to claim 1, further comprising at least one fixation lip which is formed by an undercut on the heater casing by pressing the heater casing into the receiving pocket, the fixation lip being defined in a thickness direction thereof by oppositely disposed inner surfaces, and being plastically deformed, at least in sections, and abutted against an inner surface of the receiving pocket.

4. The electric heating device according to claim 3, wherein the heater casing comprises two legs and a heater casing bottom connecting the legs to one another so as to form a substantially U- or V-shaped receiving space for the PTC element and the at least one conductor track, and wherein at least one fixation lip is provided on at least one of the legs, or two fixation lips are provided on oppositely disposed sides of the heater casing bottom.

5. The electric heating device according to claim 3, wherein the heater casing comprises two legs and a heater casing bottom connecting the legs to one another so as to form a substantially U- or V-shaped receiving space for the PTC element and the at least one conductor track, and wherein at least one fixation lip is provided on at least one of the legs, and two fixation lips are provided on oppositely disposed sides of the heater casing bottom.

6. The electric heating device according to claim 1, wherein the heater casing comprises an abutment surface which, in a press-in direction thereof, is arranged at a rear end thereof and is adapted for the application of a pressing tool.

7. The electric heating device according to claim 1, wherein the heater casing comprises at least one inwardly facing locking projection.

8. The electric heating device according to claim 1, wherein the heater casing is an extruded heater casing.

9. The electric heating device according to claim 1, wherein the heater casing is a pultruded heater casing.

10. A method for producing an electric heating device, comprising:

providing a housing with a partition wall which separates a connection chamber from a heating chamber for dissipating heat and from which at least one receiving pocket protrudes into the heating chamber as a heating rib protrudes;

introducing a PTC heating device into a heater casing of the PTC heating device, the PTC heating device including at least one PTC element and conductor tracks for energizing the PTC element with different polarities which are electrically conductively connected to the PTC element; and pressing the heater casing into the receiving pocket subject to plastic deformation of at least one of the heater casing and the receiving pocket; and wherein the heater casing is cold-welded to the receiving pocket.

11. The method according to claim 10, wherein the heater casing is introduced into the receiving pocket in such a way that a heater casing bottom is plastically deformed in the bottom of the receiving pocket.

12. The method according to claim 10, wherein the PTC element and the at least one conductor track are first introduced into the heater casing and the heater casing thus populated then is introduced into the receiving pocket.

13. The method according to claim 12, wherein the heater casing is gripped for insertion by an insertion tool, by which the heater casing is abutted against the PTC element subject to deformation before the heater casing is inserted into the receiving pocket.

* * * * *